US005757407A

United States Patent [19]

Rezanka

[11] Patent Number: 5,757,407

[45] Date of Patent: May 26, 1998

[54] LIQUID INK PRINTER HAVING MULTIPLE PASS DRYING

[75] Inventor: Ivan Rezanka, Pittsford, N.Y.

[73] Assignee: Xerox Corporation, Stamford, Conn.

[21] Appl. No.: 753,457

[22] Filed: Nov. 25, 1996

[51] Int. Cl.[6] ..... B41J 2/01

[52] U.S. Cl. ..... 347/102; 347/104

[58] Field of Search ..... 347/101, 102, 347/104; 101/488; 219/216; 355/285–295; 399/68, 336

[56] References Cited

U.S. PATENT DOCUMENTS

| | | | |
|---|---|---|---|
| 4,575,729 | 3/1986 | Ayers et al. | 347/102 |
| 4,970,528 | 11/1990 | Beaufort et al. | 346/25 |
| 4,982,207 | 1/1991 | Tunmore et al. | 346/138 |
| 5,214,442 | 5/1993 | Roller | 346/1.1 |
| 5,287,123 | 2/1994 | Medin et al. | 346/140 R |
| 5,349,905 | 9/1994 | Taylor et al. | 101/488 |

*Primary Examiner*—Benjamin R. Fuller
*Assistant Examiner*—Juanita Stephens
*Attorney, Agent, or Firm*—Daniel J. Krieger

[57] ABSTRACT

A method and apparatus for drying liquid ink deposited, in response to image data, on a recording medium moving along a path at a predetermined rate. A recording medium having liquid ink deposited thereon is moved past a dryer in multiple passes to dry areas of high ink coverage. Ink characteristics are optimized for minimum print defects by determining the time between printing and drying. In the case of text only images only one pass through the dryer is required. For areas of high ink coverage, however, multiple passes through the dryer are required and completed either by reciprocation or recirculation at the same predetermined rate.

15 Claims, 3 Drawing Sheets

LIQUID INK PRINTER HAVING MULTIPLE PASS DRYING

FIELD OF THE INVENTION

This invention relates generally to a liquid ink printer and more particularly the drying of liquid ink images formed by a liquid ink printer.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a drop or spot of ink is deposited.

The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage which is reciprocated to print one swath of information (having a width equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks and particularly those used in thermal ink jet printing, include a colorant or dye and a liquid which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types which can include infrared heating, conductive heating and heating by microwave energy.

Active drying of the image can occur either during the imaging process or after the image has been made on the recording medium. In addition, the recording medium can be preheated before an image has been made to precondition the recording medium in preparation for the deposition of ink. Preconditioning of the recording medium typically prepares the recording medium for receiving ink by driving out excess moisture which can be present in a recording medium such as paper. Not only does this preconditioning step reduce the amount of time necessary to dry the ink once deposited on the recording medium, but this step also improves image quality by reducing paper cockle and curl which can result from too much moisture remaining in the recording medium.

Various drying mechanisms for drying images deposited on recording mediums are illustrated and described in the following disclosures which may be relevant to certain aspects of the present invention.

In U.S. Pat. No. 4,970,528 to Beaufort et al., a method for uniformly drying ink on paper from an ink jet printer is described. The printer includes a uniform heat flux dryer system including a 180° contoured paper transport path for transferring paper from an input supply tray to an output tray. During transport, the paper receives a uniform heat flux from an infrared bulb located at the axis of symmetry of the paper transport path.

U.S. Pat. No. 4,982,207 to Tunmore et al. describes a heater construction for an ink jet printer having a rotary print platen for holding and transporting a print sheet through a print path. The platen heater includes a hollow shell mounted for rotation through the print path and has vacuum holes for sheet attachment.

U.S. Pat. No. 5,214,442 to Roller describes an adaptive dryer for a printing system. Values representing the mass of ink and/or area coverage of ink on a page varies one or both of the feed rate of the pages through the dryer and temperature of the drier to more closely adapt the drying parameters with the particular drying criterion each page requires for optimal quality.

U.S. Pat. No. 5,287,123 to Medin et al., describes a color ink jet printer having a heating blower system for evaporating ink carriers from the print medium after ink-jet printing. A print heater halogen quartz bulb heats the underside of the medium via radiant and convective heat transfer through an opening pattern formed in a print zone heater screen.

U.S. Pat. No. 5,349,905 to Taylor et al. describes a thermal ink jet printer incorporating a copy speed feed control for reducing peak power requirements. The speed of the sheet transport system is controlled in accordance with a determination of the density of the printed image from image print data where energy required for ink drying.

SUMMARY OF THE INVENTION

In accordance with one aspect of the present invention, there is provided a liquid ink printer of the type in which liquid ink is deposited, in response to image data, on a recording medium, moving along a path and through a printzone. The liquid ink printer includes a liquid ink printhead, disposed adjacent to the path, adapted to deposit liquid ink on the recording medium in response to the image data, a dryer, disposed adjacent to the path, defining a drying zone adapted for drying the liquid ink deposited on the recording medium, and a recording medium transport, disposed adjacent to the dryer, adapted to transport a portion of the recording medium through the drying zone in multiple passes.

Pursuant to another aspect of the invention, there is provided a method of drying liquid ink deposited on a recording medium moving along a path, through a printzone at a predetermined rate, of a liquid ink printer including a dryer defining a drying zone. The steps include determining the amount of liquid ink deposited on the recording medium, and moving a portion of the recording medium through the drying zone in multiple passes as a function of the determined amount of liquid ink.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
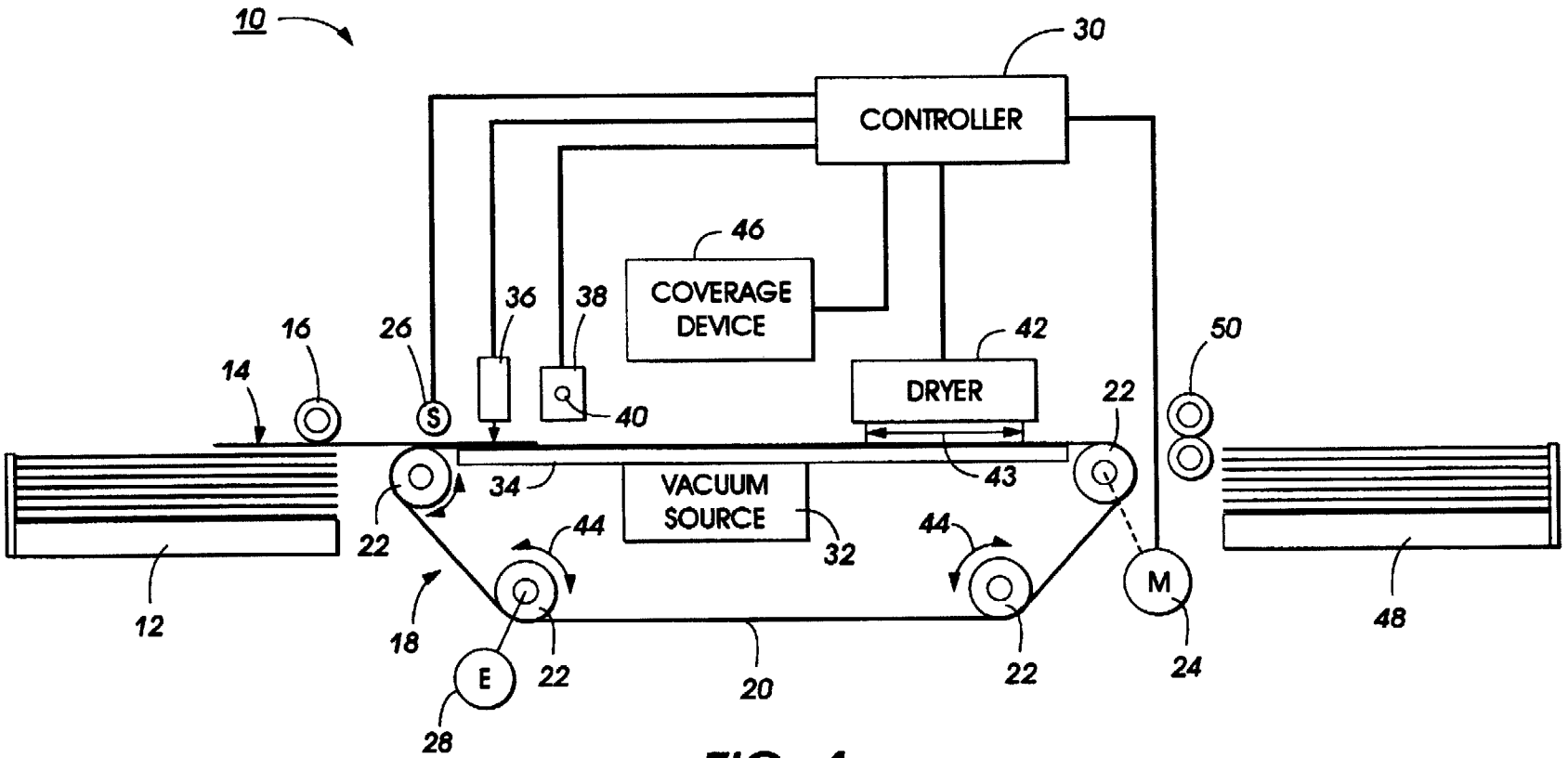
FIG. 1 is a schematic side elevational view of a liquid ink printer including a recording medium transport and a dryer of the present invention.

FIG. 1 illustrates a schematic side view of a liquid ink printer 10, for instance, an ink jet printer, of the present invention. The liquid ink printer 10 includes an input tray 12 including sheets of a recording medium 14 to be printed upon by the printer 10. Single sheets of the recording medium 14 are removed from the input tray 12 by a pickup roller 16 and fed to a recording medium transport 18. The recording medium transport 18 moves the sheet by a transport belt 20 driven by rollers 22 being moved by an electromover or motor 24. As the recording medium is transferred to the belt 20 from the input tray 12, a sensor 26 senses the location of the recording medium 14 on the belt and in combination with an encoder 28 provides the location of the recording sheet 14 as is moves through the printer 10. The motor 24, the sensor 26, and the encoder 28 are all coupled to a controller 30 which provides the necessary control functions for controlling the movement of the sheet 14 as it passes through the printer.

As the sheet is directed to the belt 20, a vacuum source 32 applies a vacuum through a vacuum applicator 34 disposed on the side of the belt opposite the recording medium such that a vacuum is applied through a plurality of apertures (not shown) located within the belt. Electrostatic affixation to the belt is also possible. In this fashion, the recording sheet is held in a stable position for printing by a page width print bar 36 supported in a printing position by a printhead support (not shown) in a confronting relation with the belt 20. In addition, a scanning printhead 38 supported by a carriage support 40, such as a lead screw, moves the scanning printhead 38 in a reciprocating motion back and forth across the surface of the recording sheet 14. The page width printbar 36 can include an array of print nozzles, for instance, staggered or linear arrays, having a length sufficient to deposit ink in a print zone across the width of the recording medium 14.

The page width printbar 36, for instance, deposits black ink for printing in monochrome and the scanning printhead 38 might print colored inks for creating a color document or a highlight color document. Each of the printheads 36 and 38 includes an ink supply (not shown) either attached to the printhead itself or coupled to the printheads through appropriate supply tubing. The recording sheet 14 is carried by the belt 20 past the printheads at a predetermined feed rate and past a dryer 42 for drying the liquid ink deposited thereon. The dryer 42 can include any number of known dryers such as microwave dryers or quartz lamp type dryers which generate sufficient heat energy to dry the liquid ink which has been deposited upon the recording sheet. If, however, the dryer 42 is a microwave dryer, the microwave dryer might encompass both sides of the belt such that microwaves are passed through the recording sheet as well as the belt 20. In this case, the belt 20 is preferably made of a material substantially transparent to microwave power and having a relatively low dielectric constant.

The controller 30 controls the operation of the recording medium transport 18 which includes the belt 20, the rollers 22, and the motor 24. In addition, the controller 30 controls the application of ink through the printhead 36 and the printhead 38 as well as the application of heat energy developed by the dryer 42. The controller 30 can include a plurality of individual controllers, such as microprocessors or other known devices dedicated to perform a particular function. For instance, a first controller might control only the transport functions while a second controller might control the deposition of ink upon the recording sheet 14.

As is understood by those skilled in the art, it is well known and commonplace to program and execute imaging, printing, document, and/or paper handling control functions and logic with software instructions for conventional or general purpose microprocessors such as the controller 30. This is taught by various prior patents and commercial products. Such programming or software may, of course, vary depending on the particular functions, software type, and microprocessor or other computer system utilized but will be available to or readily programmable without undue experimentation from functional descriptions, such as those provided herein or prior knowledge of functions which are conventional, together with general knowledge in the software and computer arts. Such knowledge can include object oriented software development environments such as C++. Alternatively, the disclosed system or method may be implemented partially or fully in hardware, using standard logic circuits or a single chip using VLSI designs.

It has been found that printing speeds for liquid ink printers above ten pages per minute are possible using partial width arrays and/or page width printbars such as the printbar 36. The power requirements to dry images printed at above ten pages per minute, however, would be high if the dryer is designed to dry at full printing speed any portions of the image which include large amounts of ink, also known as high area coverage. An examination of the large majority of printing jobs, particularly in the local area network connected environment are, however, text images with low area coverage and consequently need much less power to be dried effectively.

In the ink jet printer 10 of FIG. 1 with the dryer 42, spatial separation of printing operations and drying results in a time delay between the printing of the image and the drying thereof. During this time, the wet highly mobile image resulting from the deposited ink is free to interact with the paper. Consequently, the ink is typically designed such that a minimum of print quality defects occur during the time from printing to the time of drying. One known solution to drying such documents is to reduce the transport speed of the recording medium transport such that images with high area coverage are dried by slowing down the motion of the paper. Likewise, this increases the delay time between printing and drying and consequently increases proportionately the appearance of printing defects in the first instance or increases the severity of any printing defects which might occur. For instance, if the majority of the recording medium 14 includes high area coverage, the portion of the document entering a drying zone 43, defined by the location of the dryer 42, would be dried first at a slower rate to adequately dry that portion of the image while the portion of the image which resides outside the drying zone has a chance to develop print defects such as bleed or feathering.

To overcome this problem, it is proposed to print all images at the same nominal speed or predetermined feed rate and to dry the images or portions of the recording sheet having high area coverage by passing the recording medium or portions thereof several times through the dryer, that is in multiple passes. In this fashion, the delay time between the printing and drying remains the same and equal to the delay time for which the ink has been optimized. By drying the image on the recording sheet 14 having high area coverage in multiple passes at the same predetermined feed rate, the printing of documents can be optimized. This is especially true for office printers, typically connected over a local area network, where the majority of printing being performed is that of text. The ink as well as the dryer and its application of heat energy would be optimized for the printing of text only, such that a single pass through the dryer is necessary to dry the printed text. If, however, the image being printed includes high areas of ink coverage, which is less likely to occur in an office environment, multiple passes through the drying zone are applied to only those recording mediums having such images.

As embodied in the printer 10 of FIG. 1, the motor 24 is a bidirectional motor which causes the rollers 22 to move bi-directionally as illustrated by the arrows 44. A coverage device 46 coupled to the controller 30 determines when areas of high ink coverage are being deposited on the recording sheet 14. In one embodiment of the present invention, the coverage device includes an electrical circuit which counts the number of drops being deposited by the printheads 36 and 38 as well as determining the areas of high ink coverage which can be determined from signals received from the sensor 26 as well as the encoder 28. Such information is then processed by the controller 30 so that when the recording sheet 14 enters the dryer 42, the motor 24 is caused to move in a first direction and then in a second direction such that two or more multiple passes of the recording sheet can be made through the drying zone 43. In an alternative embodiment, the coverage device 46 might include a sensor array which can optically sense the areas of high ink coverage on the recording medium 14, the information being transmitted as a signal to the controller 30 for controlling the motor 24. Once the ink on the recording medium 14 has been dried sufficiently, it is passed to an output tray 48 aided by the application of a roller 50 for moving the recording sheets therein.

Figure 2:
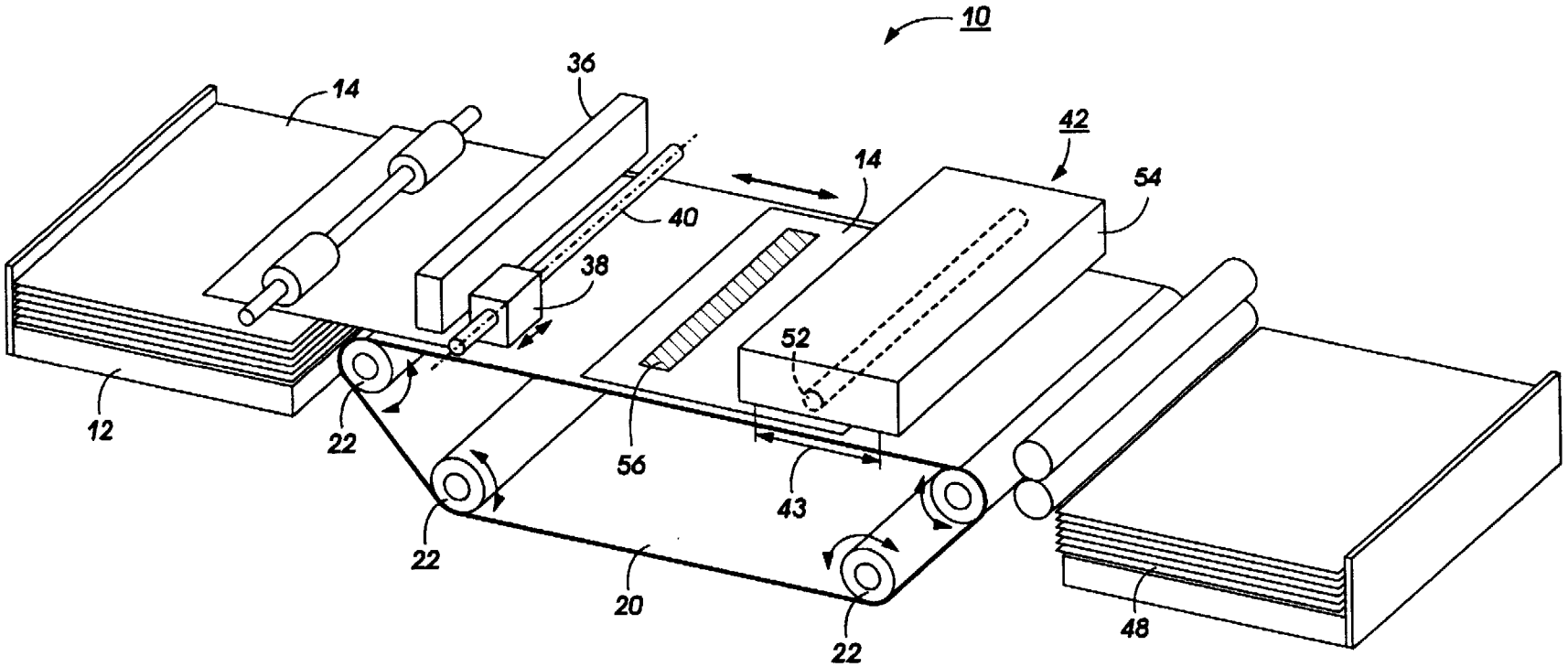
FIG. 2 is a schematic perspective view of a recording medium moving along a path beneath a dryer.

FIG. 2 illustrates a perspective view of certain elements of the ink jet printer 10 including a specific embodiment of the dryer 42 including a quartz lamp 52 and a reflector 54 defining the drying zone 43.

Once the recording sheet 14 has been printed upon by either the printbar 36 and/or the printhead 38, the recording sheet 14 passes beneath the dryer 42 and more importantly through the drying zone 43. As illustrated, the recording sheet 14 includes a portion 56 having an area or portion high ink coverage. Due to the signals generated by and transmitted between the sensor 26, the encoder 28, the coverage device 46, and the controller 30, the area of high ink coverage 56, the location thereof on the recording sheet 14 and the location of the recording sheet 14 on the belt 20 is determined. Consequently, as the recording sheet passes, at the predetermined rate, through the drying zone 43, any portion of the recording sheet which includes text is passed through the drying zone 43 a single time. Once, however, the portion 56 enters the drying zone, the transport speed of the belt 20 determined by the motor 24 remains the same but the motor 24 will reverse direction once the portion 56 has passed through the drying zone 43 a first time such that the belt moves in an opposite direction thereby moving the portion 56 through the drying zone 43 a second time. Depending on the amount of ink deposited in the portion 56, the motor 24 might reverse directions multiple times such that the process speed of the belt remains the same but that the portion 56 is passed through the drying zone 43 multiple times. While the portion 56 is shown to cover only a small amount of the recording medium 14, the portion including high area coverage might include the entire recording sheet such that the entire recording sheet must be passed through the drying zone multiple times. Once drying is complete, the recording sheet is passed onto the output tray 48.

Figure 3:
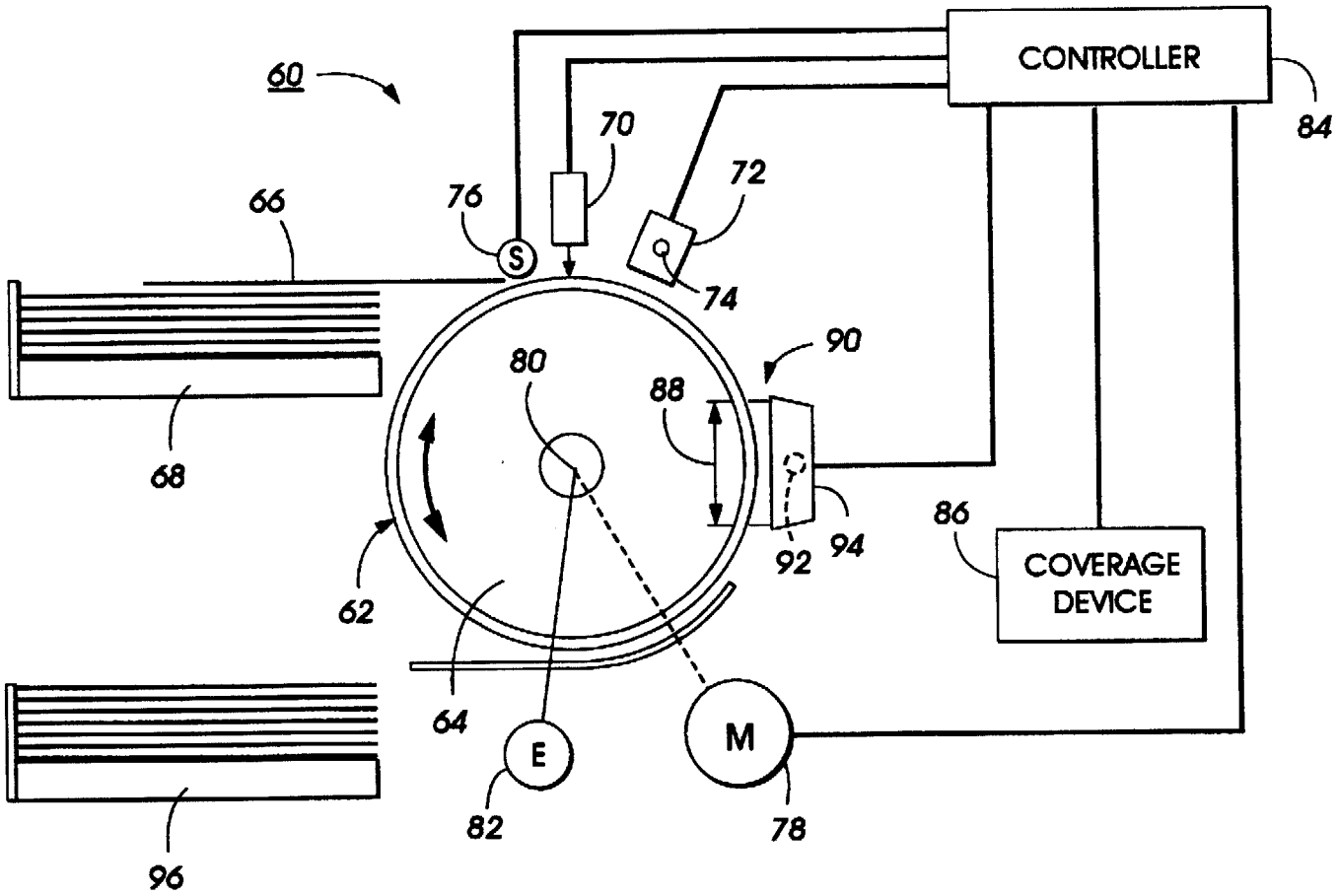
FIG. 3 is a schematic side elevational view of a second embodiment of a liquid ink printer having a rotating drum and a dryer of the present invention.

FIG. 3 illustrates another embodiment of the present invention. An ink jet printer 60 including a recording medium transport 62, embodied as a rotating drum 64 receives a sheet of a recording medium 66 from an input tray 68. The recording medium 66 is moved onto the drum by a placement mechanism (not shown) wherein once the recording medium 66 is in contact with the drum 64, the recording medium 66 remains attached to the drum including vacuum attachment, electrostatic charge or other mechanisms known by those skilled in the art. As before, the ink jet printer can include a page width printhead 70 and a scanning printhead 72 supported by a carriage rail 74 for depositing liquid ink on the recording medium. In addition, a sensor 76 senses the location and placement of the recording sheet on the drum. The rotation of the drum is controlled by a bidirectional electromover or motor 78 coupled to the drum either directly at the axis 80 or indirectly through a belt system. An encoder 82, as is known by those skilled in the art, monitors the rotational location of the drum as well as providing input for the location of the recording sheet 66 on the drum. As before, a controller 84 receives information from the sensor 76 as well as the motor 78 and a coverage device 86 as previously described.

Once printing has begun, the leading edge of the recording medium 66 enters a drying zone 88 formed by a dryer 90, here including a quartz lamp 92 and a reflector 94. Other known dryers are also possible, including microwave dryers and conductive dryers, such as provided by heated drum itself. If the coverage device 86 determines that the recording medium 66 contains text only, then the recording medium passes through the drying zone 88 and out onto an output tray 96 where recording sheets are deposited once being printed. If, however, the carriage device 86 determines that portions or substantially all of the recording medium 66 include areas of high ink coverage, then the motor 78 controls the movement of the recording sheet 66 through the printing zone 88 for traversing therethrough in multiple passes.

For instance, depending on the size of the rotating drum 64 the sheet 66 might be passed through the drying zone 88 multiple times by rotating the drum in the same direction many revolutions such that the leading edge of the sheet is the first portion of the document to enter the drying zone 88 during each of the multiple passes. If, however, the coverage device 86 determines that a small portion of the recording sheet is covered with an area of high ink coverage, then the motor 78 in combination with the encoder 82 would move that particular portion of the printed image back and forth beneath the dryer.

It is also possible, however, to rotate the drum in a single direction even for recording sheets having small areas of high coverage depending on the rotating speed of the drum 64 as well as the size and circumference of the drum.

In recapitulation, there has been described a method and apparatus for printing with liquid ink including efficient drying in the ink jet printing system. It is, therefore, apparent that there has been provided in accordance with the present invention, a liquid ink printer having multiple pass drying that fully satisifes the aims and advantages hereinbefore set forth. While this invention has been described in conjunction with specific embodiments thereof, it is evident that many alternatives, modifications and variations will be apparent to those skilled in the art. The present invention is not limited to ink jet printers including page width printbars and reciprocating printheads but is equally applicable to any liquid ink printer including any combination of page width printbars or partial width arrays or scanning carriage type of printheads. Accordingly, it is intended to embrace all such alternatives, modifications and variations that fall within the spirit and broad scope of the appended claims.

What is claimed is:

1. A liquid ink printer in which liquid ink is deposited, in response to image data, on a recording medium moving along a path and through a print zone, comprising:

a liquid ink printhead, disposed adjacent to the path, to deposit liquid ink on the recording medium in response to the image data;

a dryer, disposed adjacent to the path, defining a drying zone to dry the liquid ink deposited on the recording medium;

a recording medium transport, disposed adjacent to said dryer, including a bidirectional electromover, to transport a portion of the recording medium along the path through the drying zone bi-directionally in multiple passes and through the printzone and the drying zone at a predetermined rate, said portion of the recording medium including areas of high ink coverage requiring additional drying;

a controller, coupled to said recording medium transport, to move said portion of the recording medium through the drying zone in multiple passes; and an ink coverage device, coupled to said controller, to generate an output signal to said controller indicating a location of said portion of the recording medium including areas of high ink coverage, causing said controller to move said portion of the recording medium through the drying zone in multiple passes.

2. The liquid ink printer of claim 1, wherein said portion of the recording medium includes substantially an entirety of the recording medium.

3. The liquid ink printer of claim 1, wherein said recording medium transport comprises a belt transport, to move said portion of the recording medium through the drying zone in multiple passes.

4. A liquid ink printer in which liquid ink is deposited, in response to image data, on a recording medium moving along a path and through a print zone, comprising:

a liquid ink printhead, disposed adjacent to the path, to deposit liquid ink on the recording medium in response to the image data;

a dryer, disposed adjacent to the path, defining a drying zone, to dry the liquid ink deposited on the recording medium;

a recording medium transport, disposed adjacent to said dryer, to transport a portion of the recording medium along the path through the drying zone in multiple passes and through the printzone and the drying zone at a predetermined rate, including a belt transport, said belt transport including a bidirectional electromover, to move said portion of the recording medium bi-directionally through the drying zone, said portion of the recording medium including areas of high ink coverage requiring additional drying;

a controller, coupled to said recording medium transport, to move said portion of the recording medium through the drying zone in multiple passes; and an ink coverage device, coupled to said controller, to generate an output signal to said controller indicating a location of said portion of the recording medium including said areas of high ink coverage, causing said controller to move said portion of the recording medium through the drying zone in multiple passes.

5. The liquid ink printer of claim 4, wherein said belt transport includes a belt defining a plurality of apertures, the plurality of apertures to hold the recording medium to said belt upon an application of a vacuum therethrough.

6. The liquid ink printer of claim 5, wherein said belt transport includes a vacuum supply, disposed adjacent to said belt, to apply a vacuum through the plurality of apertures of said belt.

7. The liquid ink printer of claim 1, wherein said recording medium transport comprises a drum, to move said portion of the recording medium through the drying zone in multiple passes.

8. A method of drying liquid ink deposited on a recording medium moving along a path through a printzone at a predetermined rate of a liquid ink printer including a dryer defining a drying zone, comprising the steps of:

providing a portion of the recording medium with areas of high ink coverage;

providing a bi-directional electromover for transporting the recording medium;

determining an amount of liquid ink deposited on the recording medium; and moving the portion of the recording medium by the bi-directional electromover through the drying zone in multiple passes as a function of the determined amount of liquid ink.

9. The method of claim 8, wherein said moving step comprises moving a portion of the recording medium through the drying zone at the predetermined rate.

10. The method of claim 9, comprising generating a first signal in response to said determined amount of liquid ink deposited on the recording medium, the first signal indicating that the determined amount of liquid ink deposited is capable of being dried in multiple passes through the drying zone.

11. The method of claim 10, wherein said moving step comprises moving a portion of the recording medium through the drying zone, the portion being substantially the entire recording medium.

12. The method of claim 10, wherein said moving step comprises moving the recording medium in a first direction and a second direction.

13. The method of claim 12, wherein said moving step comprises moving the recording medium in the first direction and the second direction with a belt.

14. The method of claim 12, wherein said moving step comprises moving the recording medium in the first direction and the second direction with a drum.

15. The method of claim 12, wherein said moving step comprises moving the recording medium in a single direction with a drum.

* * * * *